US006383016B1

(12) United States Patent
Ma

(10) Patent No.: US 6,383,016 B1
(45) Date of Patent: May 7, 2002

(54) FLEXIBLE PRINTED CIRCUIT ELECTRICAL CONNECTOR

(75) Inventor: Hao-Yun Ma, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/833,968

(22) Filed: Apr. 11, 2001

(30) Foreign Application Priority Data

Jan. 11, 2001 (TW) ..... 90200547 U

(51) Int. Cl.[7] ..... H01R 12/28
(52) U.S. Cl. ..... 439/495
(58) Field of Search ..... 439/495, 260, 439/67, 77

(56) References Cited

U.S. PATENT DOCUMENTS 6,056,572 A * 5/2000 Matsumoto et al. ..... 439/495
6,089,905 A * 7/2000 Shimmyo et al. ..... 439/495
6,099,346 A * 8/2000 Hashiguchi et al. ..... 439/495
6,203,345 B1 * 3/2001 Roque et al. ..... 439/495
6,210,190 B1 * 4/2001 Huang et al. ..... 439/495
6,210,209 B1 * 4/2001 Wu et al. ..... 439/495
6,224,418 B1 * 5/2001 Miura et al. ..... 439/495

* cited by examiner

*Primary Examiner*—Gary Paumen
(74) *Attorney, Agent, or Firm*—Wei Te Chung

(57) ABSTRACT

An electrical connector (1) includes an insulative housing (4), a number of electrical contacts (3) and a dielectric stuffer (2). The insulative housing includes a top wall (40), a bottom wall (42) opposite to the top wall and a pair of side walls (41) defining a receiving cavity (43) therebetween. The electrical contacts are received in the receiving cavity of the insulative housing. The dielectric stuffer is both linearly and pivotally movable with respect to the insulative housing to depress an FPC to the electrical contacts.

1 Claim, 6 Drawing Sheets

FLEXIBLE PRINTED CIRCUIT ELECTRICAL CONNECTOR

BACKGROUND OF THE INVENTION

1. Field of the Invention

The present invention relates to an electrical connector for a Flexible Printed Circuit (FPC).

2. Description of the Related Art

A Flexible Printed Circuit (FPC) electrical connector is often used to electrically connect electrical circuits of an FPC to electrical circuits of a printed circuit board or to electrical conductors of an electrical cable. A conventional FPC electrical connector for connecting an FPC to a printed circuit board usually comprises an insulative housing mounted to the printed circuit board and a plurality of electrical contacts assembled in the insulative housing. Each electrical contact comprises a soldering portion soldered to and electrically connected to the printed circuit board. The FPC is inserted into the insulative housing and electrically contacts with the electrical contacts of the FPC electrical connector.

A dielectric stuffer is assembled to the insulative housing and is adapted to press the FPC to the electrical contacts, thereby ensuring an electrical connection therebetween. The dielectric stuffer is often only capable of linearly moving, i.e., moving in a direction along which the electrical contacts extend, to loosen and/or tighten the FPC out of and/or into the electrical connector, such that it is positioned above the soldering portions of the electrical contacts, thereby blocking the access of a tool to repair faulty soldering between the soldering portions and the printed circuit board when needed.

Therefore, an improved FPC electrical connector is required to overcome the disadvantages of the prior art.

SUMMARY OF THE INVENTION

A major object of the present invention is to provide an FPC electrical connector comprising a dielectric stuffer which facilitates reparation of faulty soldering between electrical contacts thereof and a printed circuit board.

An FPC electrical connector in accordance with the present invention comprises an insulative housing, a plurality of electrical contacts, and a dielectric stuffer. The insulative housing comprises a top wall and a bottom wall opposite to the top wall and defining a plurality of passageways therein. Each electrical contact comprises a soldering portion extending beyond the insulative housing, a fixing portion received in the passageways of the bottom wall, a contacting portion spaced from the fixing portion, and a bight portion joining the fixing and contacting portions. The dielectric stuffer comprises a pair of side wings pivotally assembled to the insulative housing and a tongue portion extending into the insulative housing to press an FPC to the contacting portions of the electrical contacts. When the FPC and the tongue portion of the dielectric stuffer are pulled out of the insulative housing, the dielectric stuffer is pivoted upwardly and rearwardly to expose the soldering portions of the electrical contacts, thereby facilitating the reparation of the faulty soldering of the electrical contacts to a printed circuit board to which the FPC electrical connector is mounted.

Other objects, advantages and novel features of the invention will become more apparent from the following detailed description of the present embodiment when taken in conjunction with the accompanying drawings.

DETAILED DESCRIPTION OF THE INVENTION

Figure 1:
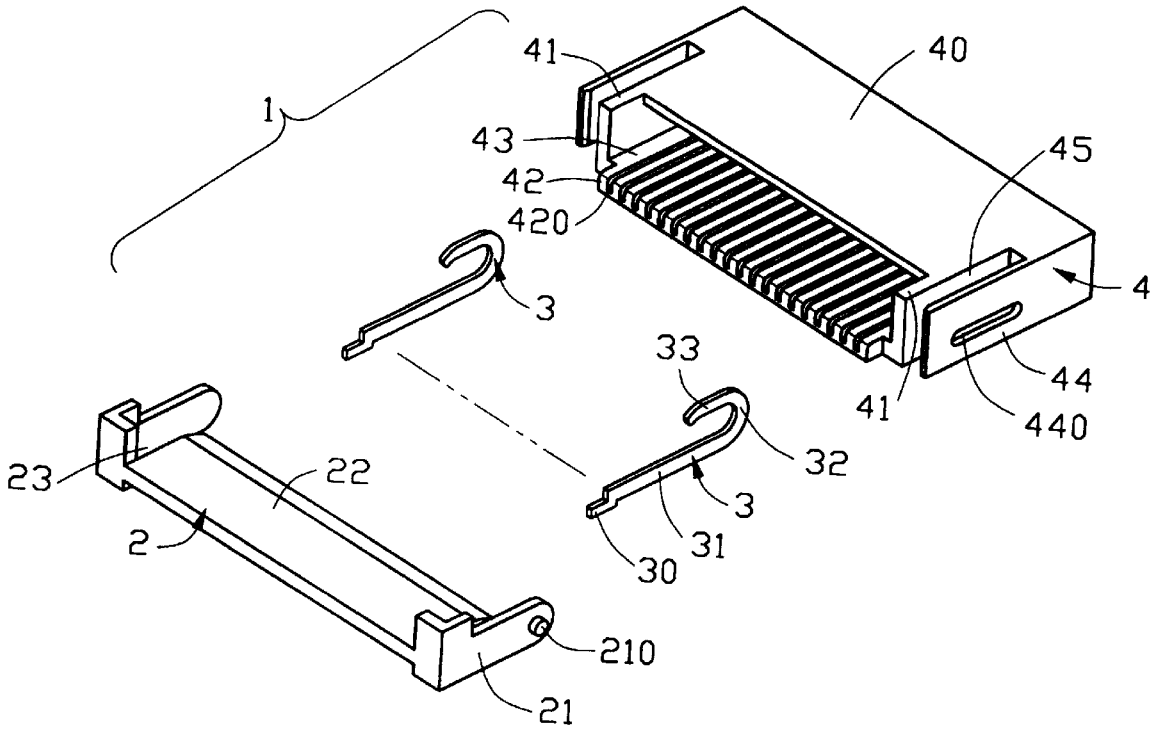
FIG. 1 is an exploded view of an FPC electrical connector in accordance with a first embodiment of the present invention.

Referring to FIG. 1, a Flexible Printed Circuit (FPC) electrical connector 1 in accordance with a first embodiment of the present invention comprises an insulative housing 4, a plurality of electrical contacts 3 and a dielectric stuffer 2.

The insulative housing 4 comprises a top wall 40, a bottom wall 42 and a pair of side walls 41 connecting the top and the bottom wall 40, 42. The top, bottom and side walls 40, 42, 41 define a receiving cavity 43 therebetween. The top wall 40 is offset from the bottom and side walls 42, 41 at a front portion thereof and is thus shorter than the bottom and side walls 42, 41 in a front-to-back direction. The bottom wall 42 defines a plurality of passageways 420 extending in the front to back direction. The insulative housing 4 further comprises a pair of arms 44 extending forwardly from opposite sides of a rear portion thereof and being respectively spaced from a front portion of the side walls 41 thereby defining a pair of cutouts 45 therebetween. Each arm 44 defines an elongated elliptical groove 440 extending in the front to back direction.

Each electrical contact 3 comprises a longitudinal fixing portion 31, a soldering portion 30, a contacting portion 33 spaced from and extending parallel to the fixing portion 31, and a bight portion 32 joining rear ends of the fixing and contacting portions 31, 33. The soldering portions 30 extend forwardly from forward ends of the fixing portions 31 and descend downwardly therefrom. The contacting portions 33 of the electrical contacts 3 extend substantially shorter than the fixing portions 31 above the fixing portions 31.

The dielectric stuffer 2 comprises a tongue portion 22 and a pair of side wings 21 extending at two opposite ends of the tongue portion 22. The tongue portion 22 is located substantially midway of the side wings 21 and together with the side wings 21 define a pair of channels 23 therebetween. Each side wing 21 has a cylindrical rib 210 protruding outwardly from a rear portion thereof.

In assembly, the fixing portions 31 of the electrical contacts 3 are received in the passageways 420 of the bottom wall 42 of the insulative housing 4 and the soldering portions 30 extend forwardly beyond a forward end of the bottom wall 42. The contacting portions 33 and the bight portions 32 are positioned in the receiving cavity 43.

The dielectric stuffer 2 is assembled to the insulative housing 4. The channels 23 receive the front ends of the side walls 41 and the side wings 21 extend into the cutouts 45. The ribs 210 of the side wings 21 movably protrude into the grooves 440 of the arms 44 of the insulative housing 4.

Figure 2:
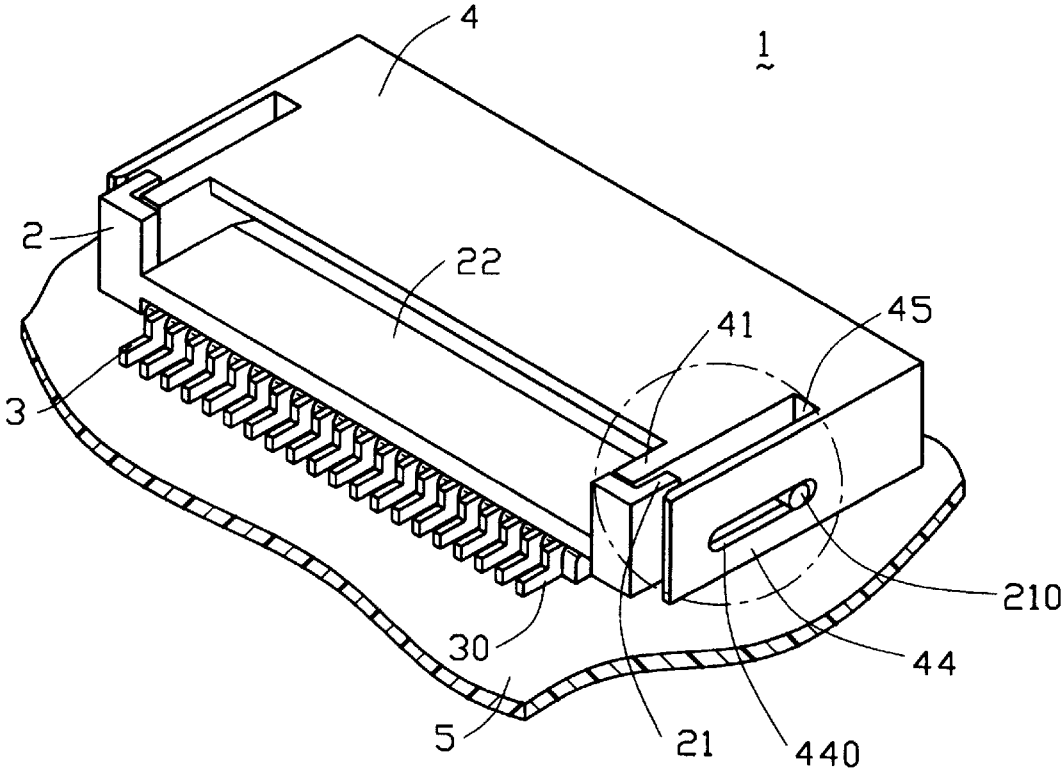
FIG. 2 is an assembled view of the FPC electrical connector of FIG. 1 mounted to a printed circuit board.
Figure 5:
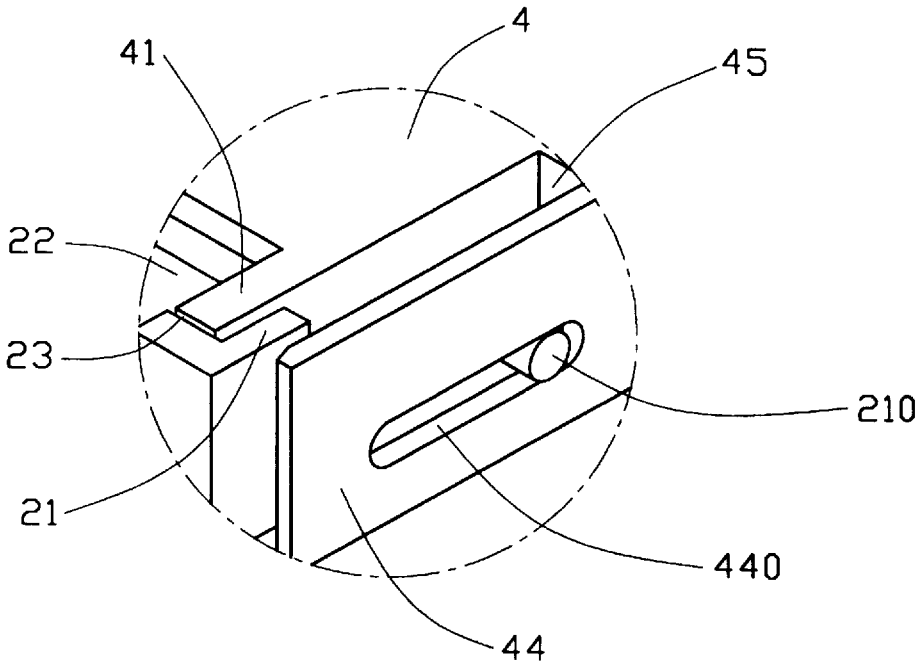
FIG. 5 is a partially enlarged view taken from a dotted-line circle of FIG. 2.
Figure 7:
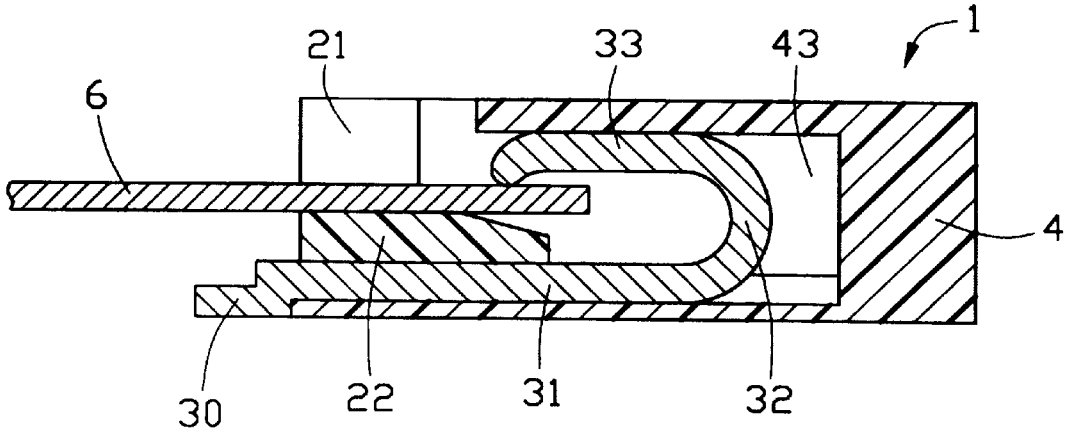
FIG. 7 is a cross-sectional view showing the electrical connector of the present invention after an FPC is inserted thereinto.

Referring to FIG. 2, in use, the electrical connector 1 is mounted to a printed circuit board 5 and the soldering portions 30 of the electrical contacts 3 are mechanically soldered to and are electrically connected with the printed circuit board 5. Referring also to FIG. 7, an FPC 6 is inserted through a top face of the tongue portion 22 of the dielectric stuffer 2 into the receiving cavity 43 of the insulative housing 4 to electrically connect with the contacting portions 33 of the electrical contacts 3. The dielectric stuffer 2 is horizontally pushed rearwardly to insert a forward section of the tongue portion 22 into the receiving cavity 43 and to further depress the FPC 6 to the contacting portions 33 of the electrical contacts 3, thereby ensuring an electrical connection therebetween. An upward movement of the contacting portions 33 of the electrical contacts 3 is stopped by the top wall 40 of the insulative housing 4 to prevent overstresses thereof. In this closed position, as best shown in FIGS. 2 and 5, the ribs 210 of the dielectric stuffer 2 are positioned at rearward ends of the grooves 440 and the dielectric stuffer 2 is in line with insulative housing 4.

Figure 3:
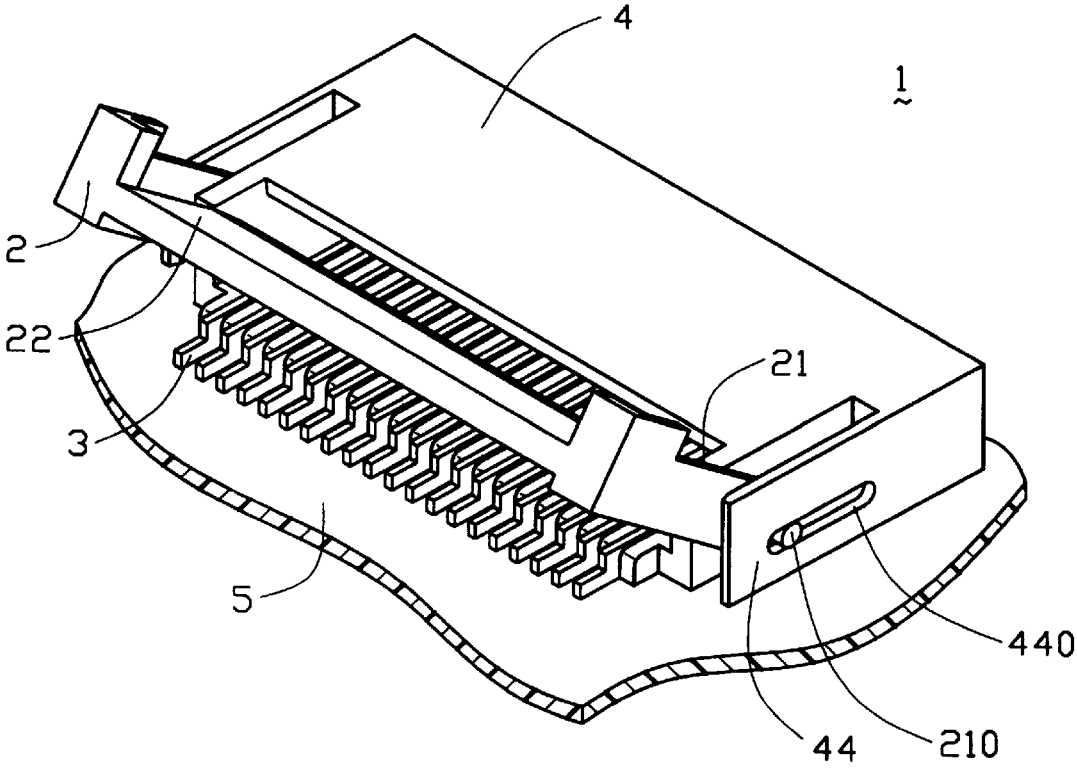
FIG. 3 is a view similar to FIG. 2 but showing a dielectric stuffer of the FPC electrical connector being pivoted upwardly.
Figure 4:
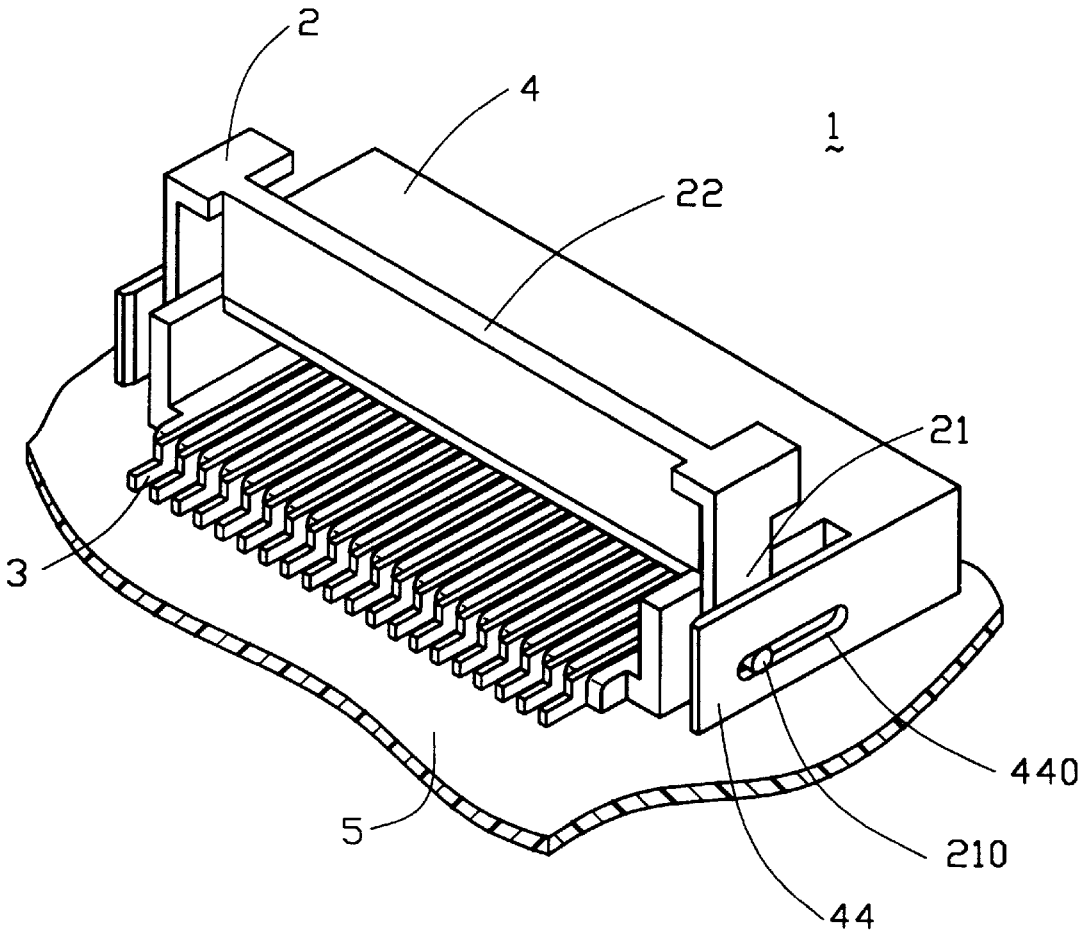
FIG. 4 is a view similar to FIG. 3 but showing the dielectric stuffer being pivoted further upwardly and rearwardly.

When the reparation of the faulty soldering between the soldering portions 30 of the electrical contacts 3 and the printed circuit board 5 is needed, the tongue portion 22 of the dielectric stuffer 2 is pulled out of the receiving cavity 43 of the insulative housing 4 and the FPC 6 is taken away. The dielectric stuffer 2 is then pivoted to an intermediate position as shown in FIG. 3 and/or further to an open position as shown in FIG. 4. In the intermediate position, the ribs 210 are positioned at the forward ends of the grooves 440 and the dielectric stuffer 2 and the top wall 40 define an obtuse angle therebetween. In the open position the dielectric stuffer 2 is perpendicular to the insulative housing 4.

Figure 6:
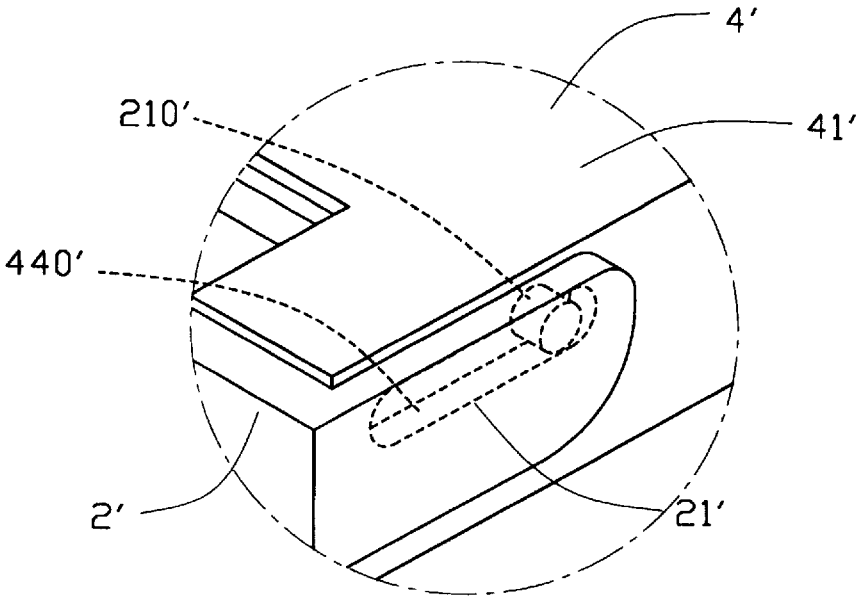
FIG. 6 is a view similar to FIG. 5, but showing an FPC electrical connector according to a second embodiment of the present invention.

Referring to FIG. 6, in accordance with a second embodiment of the present invention, a pair of elongated elliptical grooves 440' (just one shown) recess from inner faces of two side wings 21' (only one shown) of a dielectric stuffer 2' and a pair of cylindrical ribs 210' (only one shown) protrude from outside faces of the side walls 41' (only one shown) of the insulative housing 4' into the grooves 440'. The ribs 210' are movable in the grooves 440', thereby permitting the movement of the dielectric stuffer 2' relative to the insulative housing 4' in the way as described in the first embodiment.

When the dielectric stuffer 2 is located at the intermediate position and/or the open position, the soldering portions 30 are exposed outwardly, thereby easing the reparation of the faulty soldering of the soldering portions 30 to the printed circuit board 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for connecting a flexible printed circuit to a printed circuit board, comprising:

an insulative housing comprising a top wall and a bottom wall opposite to the top wall, the bottom wall defining a plurality of passageways therein;

a plurality of electrical contacts received in the passageways, each electrical contact comprising a soldering portion extending beyond the insulative housing and adapted to be mounted to a printed circuit board; and a dielectric stuffer assembled to the insulative housing and comprising a tongue portion, the dielectric stuffer being movable with respect to the insulative housing from a first position where the tongue portion is partially received in the insulative housing to depress the flexible printed circuit against the electrical contacts, to a second position where the tongue portion is moved out of the insulative housing and is substantially perpendicular to the insulative housing;

wherein the insulative housing comprises a pair of side walls connecting the top and bottom walls and a pair of arms respectively spaced from the side walls and defining a pair of cutouts therebetween, and the dielectric stuffer comprises a pair of side wings extending into the cutouts of the insulative housing;

wherein the tongue portion and the side wings define a pair of channels therebetween to partially receive the side walls of the insulative housing;

wherein the arms of the insulative housing each define an elongated elliptical groove therein and the side wings of the dielectric stuffer each comprise a respective cylindrical rib thereon to be both linearly movably and pivotally received in the grooves of the arms;

wherein the cylindrical ribs of the side wings are located at rearward ends of the elongated elliptical grooves of the arms in the first position and the cylindrical ribs of the side wings are located at forward ends of the elongated elliptical grooves of the arms in the second position.

* * * * *